US011801546B2

(12) United States Patent
Dohrmann

(10) Patent No.: US 11,801,546 B2
(45) Date of Patent: Oct. 31, 2023

(54) CABLE-TIE STRAIGHTENING DEVICE

(71) Applicant: HELLERMANNTYTON GmbH, Tornesch (DE)

(72) Inventor: Oliver Dohrmann, Uetersen (DE)

(73) Assignee: HELLERMANNTYTON GmbH, Tornesch (DE)

( * ) Notice: Subject to any disclaimer, the term of this patent is extended or adjusted under 35 U.S.C. 154(b) by 0 days.

(21) Appl. No.: 17/659,963

(22) Filed: Apr. 20, 2022

(65) Prior Publication Data

US 2022/0339691 A1 Oct. 27, 2022

(30) Foreign Application Priority Data

Apr. 21, 2021 (DE) ..... 102021203997.9

(51) Int. Cl.

| | |
|---|---|
| ***B21F 1/02*** | (2006.01) |
| ***B65B 13/18*** | (2006.01) |
| ***B65B 35/14*** | (2006.01) |
| ***B65B 13/02*** | (2006.01) |
| ***B65B 13/06*** | (2006.01) |
| ***B65B 27/06*** | (2006.01) |

(52) U.S. Cl.

CPC ..... *B21F 1/02* (2013.01)

(58) Field of Classification Search

CPC ..... B65B 13/06; B65B 13/18; B65B 13/22; B65B 13/027; B65B 35/10; B65B 35/14; B65B 27/06

See application file for complete search history.

(56) References Cited

U.S. PATENT DOCUMENTS

| | | | | |
|---|---|---|---|---|
| 3,220,443 | A | 11/1965 | Smith | |
| 2006/0278752 | A1* | 12/2006 | Belvis | B65B 41/00 100/26 |

FOREIGN PATENT DOCUMENTS

| | | | | |
|---|---|---|---|---|
| CN | 104150006 | | 11/2014 | |
| CN | 104150006 | B * | 9/2016 | |
| CN | 107098014 | | 8/2017 | |
| DE | 102013222924 | | 5/2015 | |
| DE | 102018116855 | | 1/2019 | |
| GB | 2078659 | A * | 1/1982 | B65B 13/18 |
| JP | H01220625 | | 9/1989 | |

OTHER PUBLICATIONS

English translate (CN104150006B), retrieved date Mar. 14, 2023.*
"Extended European Search Report", EP Application No. 22169135.54, dated Sep. 19, 2022, 5 pages.

* cited by examiner

*Primary Examiner* — Matthew Katcoff
*Assistant Examiner* — Mohammed S. Alawadi
(74) *Attorney, Agent, or Firm* — Colby Nipper PLLC

(57) ABSTRACT

The disclosure relates to a cable-tie straightening device including a receiving unit for receiving a cable tie, a feed unit for moving the cable tie from the receiving unit into a straightening unit, the straightening unit for straightening a strap of the cable tie, and a discharge unit for discharging the cable tie. The cable tie moved by the feed unit with a head of the cable tie pointing in the direction of the movement. The straightening unit configured to receive the cable tie, guide the strap of the cable tie through guide elements and straighten it, and also to move the cable tie into the discharge unit, with a strap tip of the cable tie pointing in the direction of the movement.

20 Claims, 2 Drawing Sheets

CABLE-TIE STRAIGHTENING DEVICE

CROSS-REFERENCE TO RELATED APPLICATION

This application claims priority to German Patent Application Number DE102021203997.9, filed Apr. 21, 2021, the disclosure of which is hereby incorporated by reference in its entirety.

BACKGROUND

Portable tools for binding material for bundling, such as for example a cable harness, by means of a cable tie, cable-tie tools for short, which are suitable for automatic or partially automatic bundling of the material for binding with cable ties at high frequency, are known from the prior art, for example DE 10 2013 222 924 A1. The most reliable operating systems in this case are systems which operate with chains or entire drum magazines of cable ties that are arranged parallel to each other. Such chains or drum magazines in this case typically have between 50 and 3500 cable ties. What is disadvantageous here is the elevated production costs for the cable-tie magazines or cable-tie chains, which are reflected in elevated operating costs relative to the use of the known loose cable ties.

CN 104 150 006 A again discloses a bundling system that is capable of also operating with loose cable ties. In this case, the loose cable ties are thrown into a vibratory vessel of a circular vibratory sorting unit and migrate from there across a sorting obstacle, what is called a chicane, into or onto a linear vibratory sorting unit that lines up the loose cable ties parallel to each other. Thence, the cable ties that are lined up in parallel are each individually pushed into a supply or conveying hose and guided pneumatically thereby to a cable-tie tool, where they are used. However, here stoppages occur again and again, since faults occur when introducing the cable ties into the conveying hose or the linear vibratory sorting unit arranges the cable ties incorrectly.

SUMMARY

Disclosed herein are cable-tie straightening devices and cable-tie straightening devices suitable for being used in a bundling system for bundling material for binding by means of a cable tie. One aspect relates to a cable-tie straightening device (CTS) that is suitable for a bundling system by means of which material for binding can be bundled with cable ties in a partially or fully automated manner. The CTS has a receiving unit for receiving a loose cable tie that is in a prescribed position, which is determined for example by a preceding sorting device of the bundling system. Furthermore, the CTS has a feed unit for moving the cable tie received from the receiving unit into a straightening unit, with the cable tie being moved by the feed unit at least with its head, headfirst, into the straightening unit. The head of the cable tie, which is arranged on a strap of the cable tie at an end of the cable-tie strap that lies opposite the strap tip of the cable tie, and points in the direction of the movement. The feed unit can therefore convey, in particular push, the cable tie at least partially, that is to say partially or in its entirety, into the straightening unit. A prescribed position may specify a prescribed situation and/or a prescribed orientation of the corresponding material, here the cable tie.

The receiving unit and feed unit thus serve to define the receiving and placing of the cable tie in the straightening unit.

The CTS includes the straightening unit for straightening the strap of the cable tie. The straightening unit may be designed to receive the cable tie, in particular to receive it completely, and to guide the strap of the cable tie upon and/or with and/or after the receiving by lateral guide elements and thus to straighten it. For receiving the cable tie, the straightening unit may have a corresponding receiving space for the cable tie. The receiving may also be or comprise active receiving, in which the cable tie is conveyed actively into the straightening unit with suitable technology, for example the pneumatic system still to be described below.

"Straightening" in the context of this disclosure is preferably to be understood to mean bringing the strap of the cable tie into a straight form. However, the prescribed form does not inevitably have to be straight in the sense of a (completely) straight line, but may also be understood more generally as bringing into a uniform form that is in particular as straight as possible. The background is that it has emerged that a very large proportion of the malfunctions in the prior art are to be ascribed to the fact that loose cable ties, for example due to influences during transport, do not have the same form, but for example are bent during transport. Accordingly, most cable ties have the same, mostly straight, cable-tie straps, but a minority of the cable ties are deformed and have corresponding differently formed, mostly curved, cable ties. The variability in the forms, in general the deviation from a straight form of the strap of the cable tie, then leads to faults in the known systems. Even if the straight form is the most suitable form for the further use of the cable tie, some advantages can also be obtained with uniform, but also non-straight, cable ties, which are thus likewise to be understood as straightened cable ties in the context of the present disclosure. Thus "straightening" may, in the context of this disclosure, also be understood in the sense of "aligning."

Furthermore, the straightening unit is designed to move the cable tie into a discharge unit, the strap tip of the cable tie pointing in the direction of the movement into the discharge unit. The cable tie is therefore introduced into the straightening unit headfirst and leaves the straightening unit in the opposite direction with its strap tip in front, in order then to be discharged and supplied for further use by way of the discharge unit, which may be connected for example to a conveying hose for cable ties in a bundling system. The discharging of the cable tie with the discharge unit in a prescribed position of the cable tie with the strap tip of the cable tie in front makes it possible to connect to known bundling systems in which mostly processing of the cable tie with the tip in front is established.

The approach described has the advantage that the reliability of known and also already-delivered bundling systems for loose cable ties can (even subsequently) be improved, namely in that it is ensured by the (possibly retrofitted) straightening unit that all the cable ties prior to being discharged into subsequent units, such as a conveying hose, have the same, ideally straight, form and accordingly are discharged with high reliability with their strap tip in front and, for example, can be fed into a corresponding conveying hose. Due to the receiving unit, the CTS can also readily be connected to known sorting devices, in particular, vibratory sorting devices. The use of two different active units for moving the cable tie within the CTS, the feed unit and the straightening unit has also proved very advantageous, since thus different transport technologies with their respective specific advantages can be used. Preferably, different technologies for moving the cable tie in each case are used in the feed unit and straightening unit. For example, as described below, mechanical pushing of the feed unit can be combined with pneumatic suction intake and forcing away of the straightening unit. The CTS described can also be operated at a very high rate, so binding cycles of 1 second and faster, for example even 0.6 seconds, can be achieved.

In one advantageous embodiment, provision is made for the straightening unit to be arranged movably, at least in part, relative to the discharge unit and/or the feed unit and/or the receiving unit and/or a housing of the cable-tie straightening device. Preferably, the receiving unit, feed unit, and discharge unit are arranged fixedly relative to the housing, and the straightening unit is movable as a whole, or at least in part, relative to the composite unit thus formed. Thus, with as small moving masses as possible the proposed reversal of direction of movement of the cable tie can be realised in a particularly simple design-related manner.

In a further advantageous embodiment, provision is made for the straightening unit to be designed to receive the cable tie in a receiving position and to move it in a distributor position that is different from the receiving position into the discharge unit. In particular, the straightening unit may be designed to move the cable tie from the receiving position into one of a plurality of different distributor positions, with the distributor position for the respective cable tie being able to be prescribed individually, for example by way of a corresponding control command Thus, a specific cable tie received at the receiving position may be associated with different distributor positions and moved into them. The straightening unit may serve as a sort of set of points for the cable ties. This is advantageous if a plurality of different successive units, for example, different conveying hoses for cable ties and accordingly a plurality of cable-tie tools, are connected to the discharge unit, which tools can thus can be supplied with the respective cable ties in a demand-oriented manner. This is particularly advantageous, since thus a single sorting device with the CTS described can supply a plurality of tie tools with cable ties. In this case, it is possible to resort to established technology—this merely has to be supplemented with the cable-tie straightening device described. Owing to the fact that the receiving position and distributor position are different, the reversal of direction of movement can be combined particularly efficiently and easily with the further use of the cable tie.

Provision may be made for the straightening unit to be designed to move the respective cable tie by a linear translatory movement, of the straightening unit or a part of the straightening unit, perpendicularly to a main direction of extent of the straightened cable tie from the receiving position to that distributor position that is desired in each case. The straightening unit can thus be moved similarly to a lift from the receiving position to the one or more distributor positions. This mode of operation corresponds to that of a rod magazine. Correspondingly, the straightening unit may alternatively be designed to move the cable tie by a respective rotatory translatory movement from the receiving position to the respective distributor position. The straightening unit may have a drum magazine for cable ties, as is known in principle from revolvers, but also from DE 10 2013 222 924 A1 mentioned first hereinbefore. The axis of the rotatory translatory movement runs along the direction of main extent of the cable ties. However, the axis of the rotatory translatory movement may also run perpendicular to the direction of main extent of the cable ties. This may, for example, be realised with a rod magazine where the cable ties are arranged in a star-shaped form. There, the rod magazine may also be designed for only one cable tie. Thus, a tunnel or tunnel element as described in the next paragraph may, for example, be combined with a hinge, which defines the axis of the rotary translatory movement perpendicular to the direction of main extent of the cable ties. Such a tunnel or tunnel element, respectively, may then be regarded as rod magazine for only one cable tie. The states of the straightening unit that correspond to the respective receiving and distributor positions of the cable ties may be referred to as respective receiving and distributor states. All approaches have the advantage that, with small moving masses and thus rapidly and robustly, the reversal of direction can be combined with the established conveying direction of cable ties in bundling systems.

In a further advantageous embodiment, provision is made for the guide elements of the straightening unit to be walls of a tunnel or of a tunnel element or to have such walls. The corresponding cable tie can then be received, in particular received completely, in this tunnel or the tunnel element. Thus, the receiving space mentioned above of the straightening unit can be formed in the interior of the tunnel. Here for example a simple square profile is suitable as a tunnel or tunnel element, in which the cable tie, by opposing tunnel walls as lateral guide elements, is guided laterally (e.g., on its strap along the main direction of extent). Alternatively, or additionally, further guide elements, for example active guide elements, are also conceivable, such as opposing synchronised belt conveying elements, that receive the cable tie between them. These embodiments too involve the simple and reliable implementation of the straightening function or promote the same.

In another advantageous embodiment, provision is made for the straightening unit to be designed to receive the cable tie pneumatically and/or to move it into the discharge unit (e.g., at a corresponding underpressure, at a corresponding excess pressure). In particular, the cable tie can be received, picked up by suction, with an underpressure in the straightening unit and moved, pressed, or fired by an excess pressure into the discharge unit. In particular, the receiving space for the cable tie in the straightening unit and a corresponding receiving space for the cable tie in the discharge unit, which when used as intended can be fluidically coupled with the conveying hose already mentioned, and can be configured to be able to be sealed off from surroundings in common. As a result, the cable tie can be moved particularly rapidly, efficiently and in a defined manner, that is to say with high process reliability. Furthermore, the same drive, namely the pneumatic system or corresponding pump installation, can be used for moving the cable tie into the straightening unit and out of the straightening unit, which further increases the reliability of the device.

In a further advantageous embodiment, provision is made for the feed unit to be designed to push the cable tie by means of a mechanical element, in particular by means of a pin element or a mandrel element, into the straightening unit. In particular, the pushing here may take place by a distance of 15 mm±10 mm, preferably by a distance of 15 mm±5 mm, particularly preferably by a distance of 15 mm±2 mm Precisely in combination with the previously-mentioned pneumatic movement within the straightening unit, mechanical feeding is advantageous here, since the cable tie can thus be brought into a position suitable for the pneumatic system in a simple manner. The distances mentioned have proved particularly advantageous here in conjunction with cable ties, since it is advantageous to keep the distance that the cable tie is moved with the mechanical element as short as possible, but it must however be large enough to permit reliable attachment to the movement in the straightening unit.

Further aspects relate to corresponding cable-tie straightening devices according to one or more of the described embodiments, in combination with a preceding sorting device for sorting loose cable ties, in particular with a circular vibratory sorting unit, having a vibratory vessel, for sorting the loose cable ties and/or a linear vibratory sorting unit for lining up the loose cable ties.

Another further aspect relates to one of the cable-tie straightening devices described in combination with one or more portable cable-tie tools coupled with the cable-tie straightening device by way of a conveying or supply hose for conveying or supplying the cable ties, which tools have in particular an integrated cable-tie reservoir. Further devices, such as, for example, heating devices for preheating the cable ties, may also be combined with the CTS. The use of cable-tie tools with an integrated cable-tie reservoir is particularly advantageous when using the cable-tie straightening device with a plurality of cable-tie tools, since thus fluctuations in the binding rate of the respective cable-tie tools can be equalised.

Another aspect also relates to a bundling system with one of the cable-tie straightening devices described and also with a preceding sorting device for sorting loose cable ties and at least one (i.e., one or more), portable cable-tie tool(s) coupled with the cable-tie straightening device by way of a conveying hose for conveying the cable ties, which tools preferably have an integrated cable-tie reservoir. The preceding sorting device may have the circular vibratory sorting unit described and/or the linear vibratory sorting unit described.

A further aspect relates to a method for straightening a cable tie, or for straightening cable ties. The method may comprise a series of method steps, namely receiving the cable tie, with a prescribed position of the cable tie, moving the received cable tie along a first direction into a straightening unit, straightening the cable tie in the straightening unit and moving the straightened cable tie, along a second direction opposite to the first direction, out of the straightening unit into a discharge unit, followed by discharging the cable tie, with a prescribed position of the cable tie. Owing to the fact that the received or discharged cable tie may have a prescribed position (e.g., a prescribed situation and/or prescribed orientation), this method is compatible with further automatic or semiautomatic methods as are already used in known bundling systems.

Advantages and advantageous embodiments of the described methods correspond to advantages and advantageous embodiments of the cable-tie straightening device described or of the bundling system described.

The features and combinations of features mentioned above in the description, also in the introductory part, and also the features and combinations of features mentioned below in the description of the drawings and/or shown in the drawings alone can be used not only in the combination indicated in each case, but also in other combinations, without departing from the scope of the present disclosure. Thus also embodiments of the disclosure that are not explicitly shown and discussed in the drawings, but emerge and can be produced by separated combinations of features from the embodiments discussed, are to be regarded as comprised and disclosed. Also, embodiments and combinations of features that thus do not have all the features of an originally-formulated independent claim are to be regarded as disclosed. Furthermore, embodiments and combinations of features, in particular due to the embodiments set out above, which go beyond or deviate from the combinations of features set out in the back-references of the claims are to be regarded as disclosed.

BRIEF DESCRIPTION OF THE DRAWINGS

Cable-tie straightening devices and cable-tie straightening devices suitable for being used in a bundling system for bundling material for binding by means of a cable tie, according to the present disclosure, will be discussed in greater detail with reference to the schematic drawings shown in the following figures, without wishing to restrict it to the specific embodiments shown here.

In the different figures, identical or functionally identical elements are provided with the same reference numerals.

DETAILED DESCRIPTION

Disclosed is a cable-tie straightening device that is suitable for being used in a bundling system for bundling material for binding by means of a cable tie.

Figure 1:
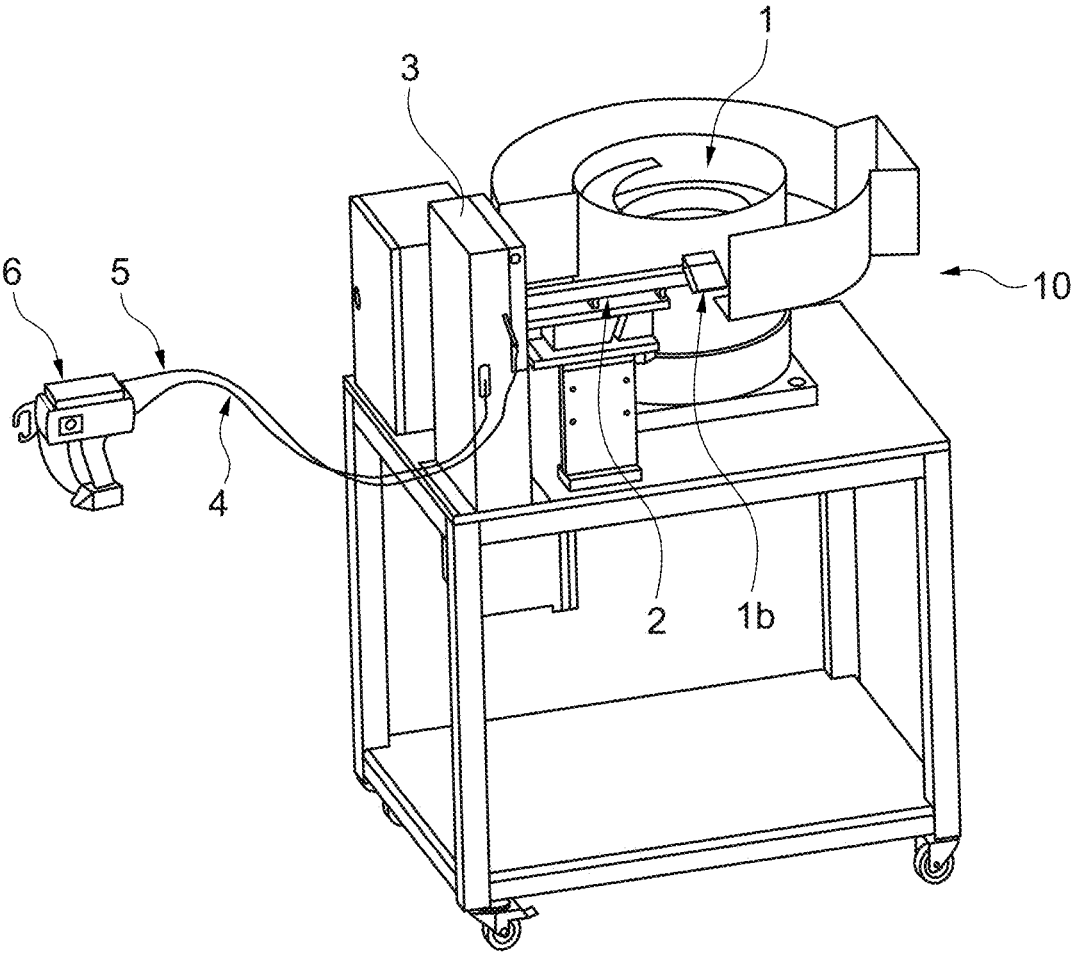
FIG. 1 shows a bundling system with a cable-tie straightening device, according to an embodiment of the present disclosure.

FIG. 1 shows a bundling system 10 of a cable-tie straightening device, according to an embodiment of the present disclosure. The bundling system 10 here in the present embodiment first of all has a circular vibratory sorting unit 1 that has a vibratory vessel into which loose cable ties 7 (FIG. 2) can be thrown. As is generally known, then when the circular vibratory sorting unit 1 is operating, cable ties are sorted in or on a linear vibratory unit 2 by way of a chicane 1*b*. Thereon or therein, the cable ties are then lined up parallel to each other and supplied to the cable-tie straightening device 3. Once the respective cable ties have been straightened there or it has been ensured that they run straight, they are conveyed, generally "fired," that is to say forced through the conveying hose 5 at a pneumatic pressure, by way of a conveying, guide, or supply hose 5 to a portable cable-binding cable tool 6.

During operation of the bundling system 10, then upon or after actuating the cable-tie tool 6 by way of a corresponding communication channel 4, which here is embodied as a cable link, corresponding replenishment of cable ties, that is to say the renewed supplying or conveying of a cable tie by way of the supply hose 5, is triggered by the cable-tie straightening device 3.

If a plurality of different portable cable-tie tools 6 are connected to the cable-tie straightening device 3, then the replenishment can be coordinated by way of the respective control signal, that is to say that it can be ensured that the cable-tie tool 6 is also accordingly supplied with cable ties when required.

Figure 2:
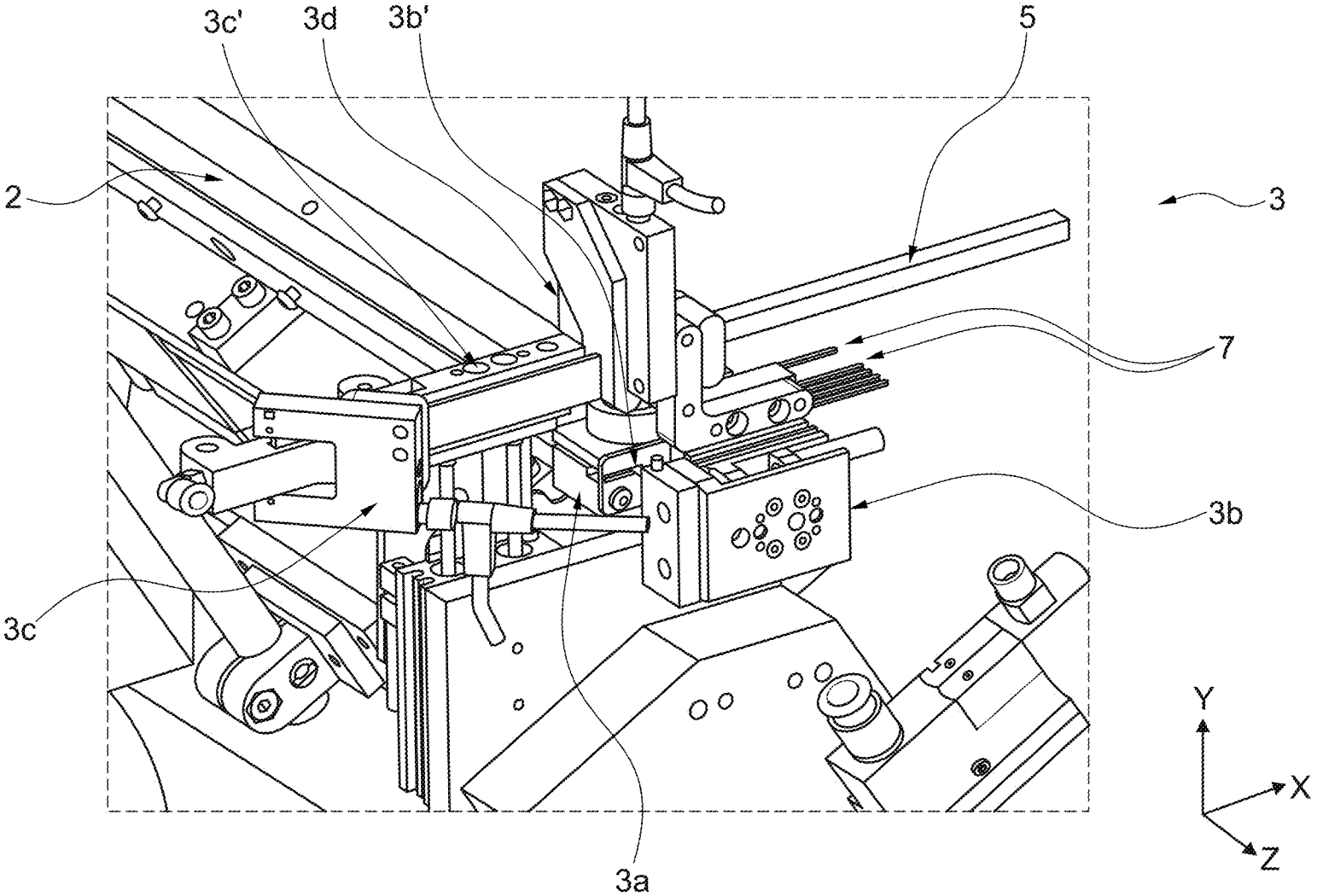
FIG. 2 shows a cable-tie straightening device according to an embodiment of the present disclosure.

FIG. 2 shows the cable-tie straightening device 3 in detail, according to an embodiment of the present disclosure. In the present embodiment, the cable-tie straightening device 3 here is coupled both to a preceding linear vibratory unit 2 and to a subsequent guide hose 5. The cable-tie straightening device 3 has a receiving unit 3*a* for receiving a respective cable tie 7 that is in a prescribed position, with its main extent running parallel to the X-axis and the cable-tie head pointing in the negative X-direction and also the cable-tie tip pointing in the positive X-direction.

A feed unit 3*b* serves for moving the cable tie 7 from the receiving unit 3*a* into the straightening unit 3*c* with at least a head of the cable tie 7. Since the movement into the straightening unit 3*c* runs in the X-direction, which in the present case is negative, the cable tie 7 thus arrives headfirst in the straightening unit 3*c*. The cable tie 7 in the example shown is displaced with a mechanical element 3*b*' (e.g., a pin element), at its head by a distance of, for example, 15 mm.

If the cable tie 7 is then received partially, in particular with its head or a part of the head, in the straightening unit 3*c*, the cable tie 7 is sucked by means of an underpressure into the straightening unit 3*c* and is guided laterally, and is thus straightened, by corresponding guide elements 3*c*'. It should be noted here that in the embodiment illustrated, the straightening unit 3*c* is arranged movably relative to the receiving unit 3*a* and the feed unit 3*b*, and thus, when used as intended in the present embodiment, at least in part, moves back-and-forth between different settings, a receiving setting for the cable tie and a distributor setting for the cable tie. The straightening unit 3*c* is illustrated in the distributor setting, which in the embodiment shown is illustrated above, that is to say offset in translation in the positive Y-direction in relation to the receiving setting. The straightening unit 3*c*, when the cable-tie straightening device 3 shown is used as intended, is thus displaced in the Y-direction between the receiving setting (receiving position) and distributor setting (distributor position). If the straightening unit 3*c* has thus received and straightened the cable tie 7, it is displaced in the positive Y-direction, so that an opening of a receiving space of the straightening unit is arranged aligned with a corresponding opening of the discharge unit 3*d* and the cable tie can be discharged into the guide hose 5 from the discharge unit 3*d* of the cable-tie straightening device 3.

Overall, thus reliable threading of the cable tie with the cable strap tip in front into the guide hose can be achieved by the cable-tie straightening device described.

What is claimed is:

1. A cable-tie straightening device, comprising:

a receiving unit for receiving a cable tie;

a feed unit for moving the cable tie from the receiving unit into a straightening unit in a direction of movement, with a head of the cable tie pointing in the direction of the movement;

the straightening unit for straightening a strap of the cable tie, wherein the straightening unit is configured to:

receive the cable tie;

guide the strap of the cable tie through guide elements and straighten the strap; and move the cable tie into a discharge unit, with a strap tip of the cable tie pointing in the direction of the movement; and the discharge unit being configured for discharging the cable tie.

2. The cable-tie straightening device according to claim 1, wherein the straightening unit is arranged movably relative to at least one of the discharge unit, the feed unit, the receiving unit, or a housing of the cable-tie straightening device.

3. The cable-tie straightening device according to claim 1, wherein the straightening unit is configured to:

receive the cable tie in a receiving position; and move the cable tie into the discharge unit in a distributor position that is different from the receiving position.

4. The cable-tie straightening device according to claim 3, wherein the distributor position is selected from a plurality of different distributor positions that can be prescribed for the cable tie.

5. The cable-tie straightening device according to claim 3, wherein the straightening unit is configured to move the cable tie by a linear translatory movement from the receiving position to the distributor position.

6. The cable-tie straightening device according to claim 1, wherein the guide elements of the straightening unit comprise walls of a tunnel configured to receive the cable tie.

7. The cable-tie straightening device according to claim 6, wherein the walls of the tunnel are configured to receive the cable tie completely.

8. The cable-tie straightening device according to claim 1, wherein the straightening unit is configured to receive the cable tie pneumatically.

9. The cable-tie straightening device according to claim 1, wherein the straightening unit further comprises a receiving space configured for receiving the cable tie.

10. The cable-tie straightening device according to claim 9, wherein the discharge unit further comprises a second receiving space configured for receiving for the cable tie, the second receiving space configured to be sealed off from surroundings in common.

11. The cable-tie straightening device according to claim 1, wherein the feed unit is configured to push the cable tie into the straightening unit by means of a mechanical element.

12. The cable-tie straightening device according to claim 11, wherein the mechanical element comprises at least one of a pin element or a mandrel element.

13. The cable-tie straightening device according to claim 11, wherein the feed unit is configured to push the cable tie into the straightening unit by a distance of 15 mm+/−10 mm.

14. The cable-tie straightening device according to claim 1, wherein the straightening unit is arranged movably relative to at least one of the discharge unit, the feed unit, the receiving unit, or a housing of the cable-tie straightening device, and wherein the straightening unit is configured to:

receive the cable tie in a receiving position; and move the cable tie into the discharge unit in a distributor position that is different from the receiving position.

15. The cable-tie straightening device according to claim 1, wherein the straightening unit is arranged movably relative to at least one of the discharge unit, the feed unit, the receiving unit, or a housing of the cable-tie straightening device, and wherein the straightening unit is configured to receive the cable tie pneumatically.

16. The cable-tie straightening device according to claim 1, wherein the straightening unit is configured to:

receive the cable tie pneumatically in a receiving position; and move the cable tie into the discharge unit in a distributor position that is different from the receiving position.

17. The cable-tie straightening device according to claim 1, wherein the straightening unit is configured to:

receive the cable tie in a receiving position; and move the cable tie into the discharge unit in a distributor position that is different from the receiving position, and wherein the feed unit is configured to push the cable tie into the straightening unit by means of a mechanical element.

18. A bundling system comprising:

a sorting device for sorting loose cable ties;

a cable-tie straightening device comprising:

a receiving unit connected to the sorting device and receiving a cable tie from the sorting device;

a feed unit for moving the cable tie from the receiving unit into a straightening unit in a direction of movement, with a head of the cable tie pointing in the direction of the movement;

the straightening unit for straightening a strap of the cable tie, wherein the straightening unit is configured to:

receive the cable tie from the feed unit;

guide the strap of the cable tie through guide elements and straighten the strap; and move the cable tie into a discharge unit, with a strap tip of the cable tie pointing in the direction of the movement;

the discharge unit being configured for discharging the cable tie; and a cable-tie tool coupled with the cable-tie straightening device by way of a conveying hose for conveying the cable ties, the cable-tie tool receiving the cable tie discharged from the discharge unit.

19. The bundling system of claim 18, wherein the cable-tie tool further comprises:

an integrated cable-tie reservoir.

20. A method comprising:

receiving a cable tie;

moving the received cable tie, in a first direction, into a straightening unit with a head of the cable tie pointing in the first direction;

straightening the cable tie in the straightening unit;

moving the straightened cable tie, in a second direction opposite to the first direction, out of the straightening unit into a discharge unit with a strap tip of the cable tie pointing in the second direction of the movement; and discharging the cable tie from the discharge unit.

* * * * *